US005112106A

United States Patent [19]

Asbjornsen et al.

[11] Patent Number: 5,112,106

[45] Date of Patent: May 12, 1992

[54] ARRANGEMENT IN CONNECTION WITH AN ADJUSTABLE BACK REST CUSHION OF A CHAIR

[75] Inventors: Svein Asbjornsen; Jan Lade, both of Sykkylven, Norway

[73] Assignee: Svein Asbjornsen & Jan Lade A/S, Skkylven, Norway

[21] Appl. No.: 473,979

[22] PCT Filed: Aug. 29, 1989

[86] PCT No.: PCT/NO89/00085

§ 371 Date: Apr. 17, 1990

§ 102(e) Date: Apr. 17, 1990

[87] PCT Pub. No.: WO90/02504

PCT Pub. Date: Mar. 22, 1990

[30] Foreign Application Priority Data

Jul. 9, 1988 [NO] Norway ..... 883983

[51] Int. Cl.[5] ..... A47C 3/00

[52] U.S. Cl. ..... 297/284 F; 297/353; 297/410

[58] Field of Search ..... 297/284 C, 284 F, 353, 297/410; 248/423, 298, 118.3, 118

[56] References Cited

U.S. PATENT DOCUMENTS 2,905,230 9/1959 Gabriel ..... 297/284 F X
3,880,463 4/1975 Shephard .
4,221,430 9/1980 Frobose ..... 297/353
4,256,341 3/1981 Goldner et al. ..... 297/410
4,451,084 5/1984 Seeley ..... 297/353
4,573,737 3/1986 Korn ..... 297/353
4,616,877 10/1986 Slaats et al. ..... 297/410 X
4,711,492 12/1987 Asbjornsen .

FOREIGN PATENT DOCUMENTS 149608 2/1984 Norway .
2149654 6/1985 United Kingdom ..... 297/284

*Primary Examiner*—Jose V. Chen
*Attorney, Agent, or Firm*—Ladas & Parry

[57] ABSTRACT

An arrangement in connection with an adjustable back rest cushion (10,16), where the cushion is connected with a slide means (4,5) which may be moved in a guide (3) forming part of the back rest (1). said guide (3) consisting of a contoured rail spaced from the back rest front, said slide means (4,5) consisting of two members, viz. a slide member (5) which is designed to be movable in a groove in said rail, solely in the longitudinal direction of said rail, and a cushion holder member (4), which at its rear portion is pivotably attached (14) to one end of a front portion of slide member (5), and is lockable by the aid of a snap lock means (15, 15', 15'') to the other end of said front portion of slide member (5), the front portion of cushion holder member (4) being provided with means (8) for engagement with cushion rear side (9).

9 Claims, 6 Drawing Sheets

Fig.6a.
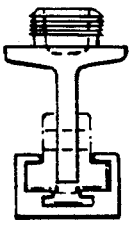
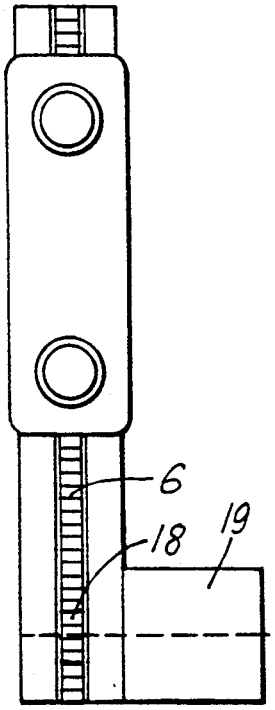
Fig.6.
Fig.9a.
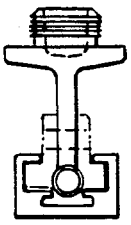
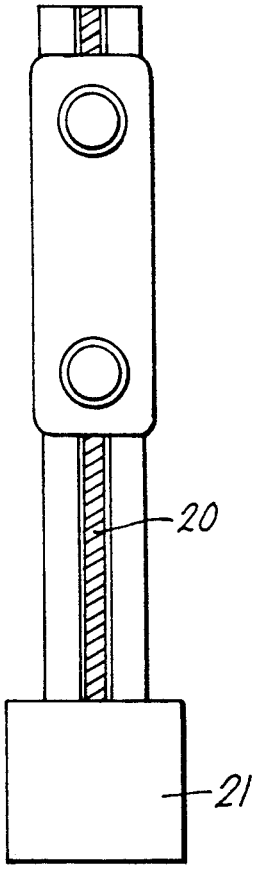
Fig.9.
Fig.5a.
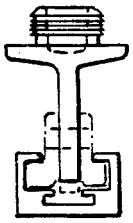
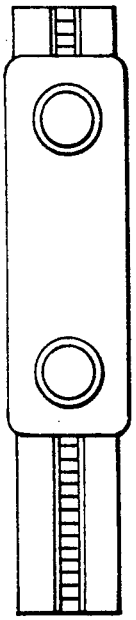
Fig.5.
Fig.12a.
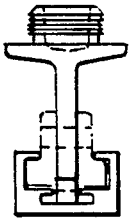
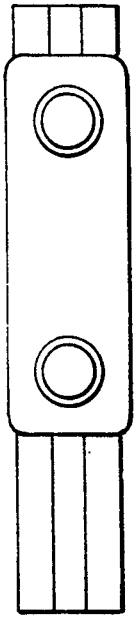
Fig.12.

ARRANGEMENT IN CONNECTION WITH AN ADJUSTABLE BACK REST CUSHION OF A CHAIR

The present invention relates to an arrangement in connection with a height adjustable back rest cushion, said cushion being connected with a slide means which is slidable along a guide constituting part of the back rest, and where said cushion may be moved relative to said slide means.

Several such arrangements are previously known, inter alia, from NO-PS 149 608.

For a long time, however, it was desired that such back rest cushions should be adjustable either manually or electrically and that it should, at the same time be possible to lock the cushion(s) relative to the back rest.

According to the present invention it is proposed that said guide is a contoured rail which is provided at a rearward distance from the back rest front, that the slide means is a two-piece means comprising a slide member designed to be moved in a groove in the rail only in the longitudinal direction of the rail, and a cushion holder member the rear portion of which is pivotably attached to one end of a front portion of the slide member and is lockable by snap locking to the other end of said front portion of the slide member, the front portion of the cushion holder member being provided with means for engagement with the rear side of the cushion.

The invention also indicates means for closing the opening appearing on the front of the back rest, on top, and below the back rest cushion, respectively.

These and further characterizing features of the present invention will appear from the following claims as well as from the following description with reference to attached drawings.

FIG. 5 illustrates the arrangement of FIG. 3 in a front view, and FIG. 5*a* is shown for completeness and corresponds to FIG. 4.

FIG. 6 shows a modification of the embodiment shown in FIG. 5 and is intended for motorized displacement of the back rest cushion.

FIG. 6*a* is shown for completeness and corresponds to FIG. 5*a*.

Figure 7:
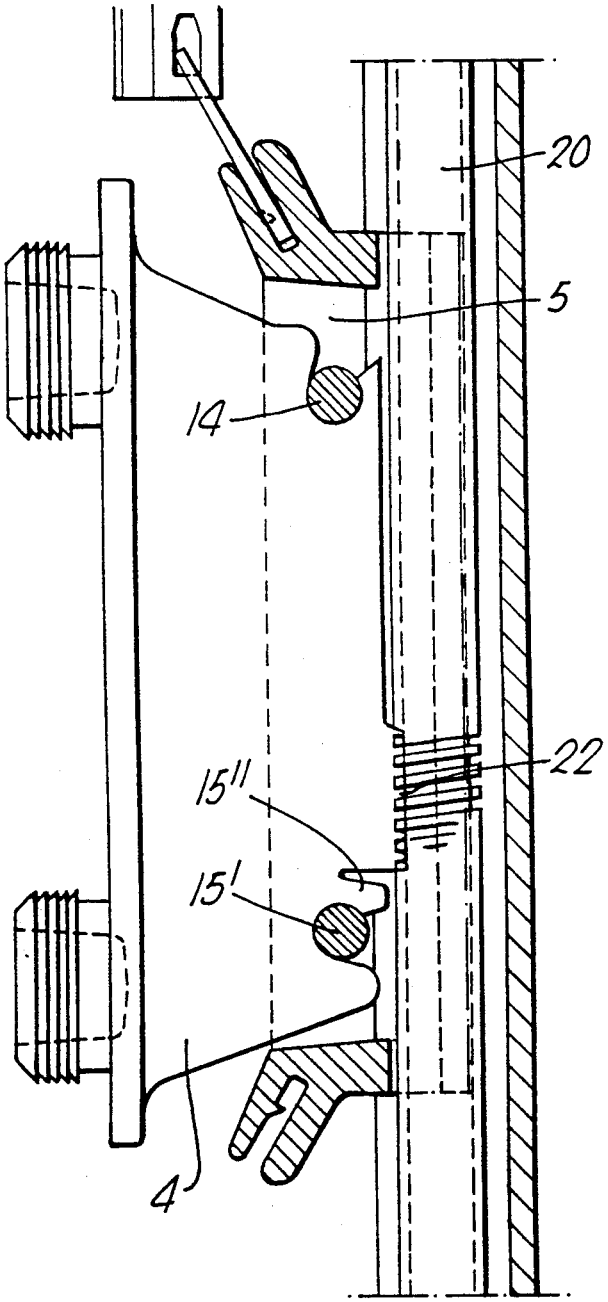

FIG. 7 illustrates another embodiment utilizing the screw principle for motorized displacement of the back rest cushion.

Figure 8:
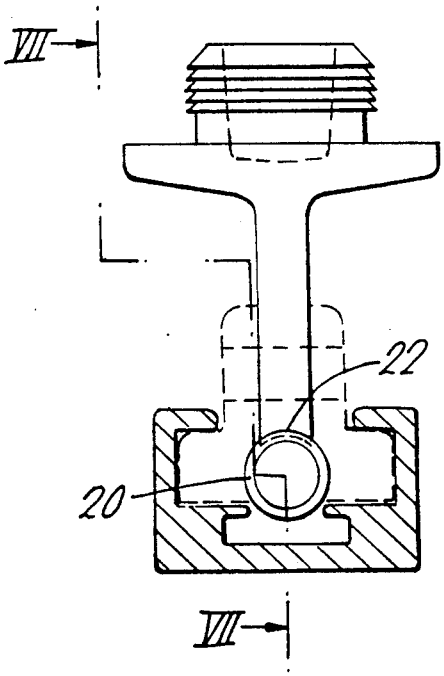

FIG. 8 is a cross sectional view of the arrangement of FIG. 7.

FIG. 9 illustrates the arrangement of FIG. 7 in a front view, and

FIG. 9*a* is shown for completeness and represents a diminution of FIG. 8.

Figure 10:
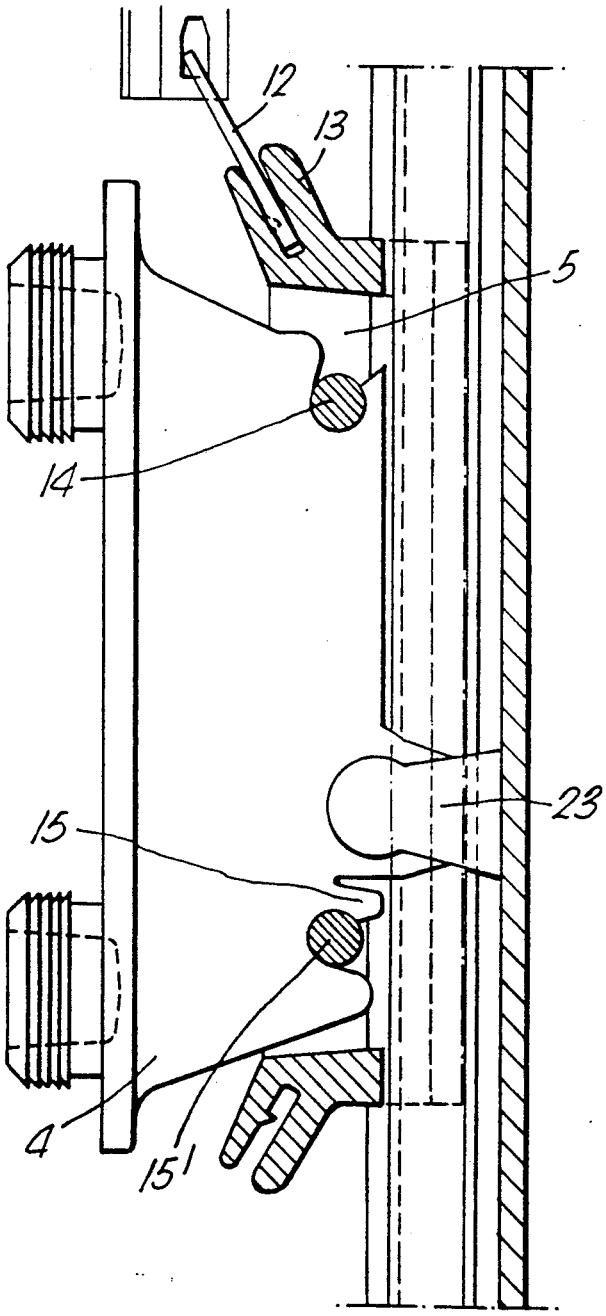

FIG. 10 shows a third embodiment of the arrangements according to the invention where displacement should be manual and the cushion is locked in place by the aid of a special friction member.

Figure 11:
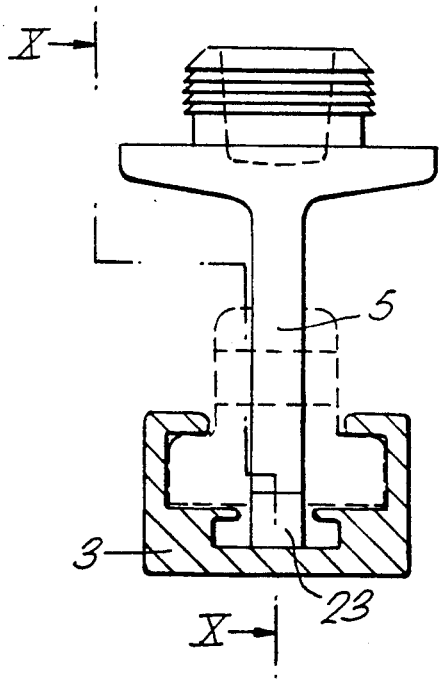

FIG. 11 shows the arranement of FIG. 10 in cross section.

FIG. 12 is a front view of the arrangement of FIG. 10, and FIG. 12*a* is a cross sectional view of the arrangement in diminution relative to FIG. 11.

In the chair comprising a back rest 1 and a seat 2, a contoured rail 3 is provided in back rest 1 at a distance from the front side of the back rest. A toothed rack or toothed belt 6 may be provided inside the contoured rail. A slide means is used for displacing back rest cushion 10 and consists of a cushion holder member 4 which in its front portion is provided with member 8 intended for engagement with a support plate 9 for cushion 10, as clearly appearing from FIG. 1. The slide means, additionally, comprises a slide member 5 which at its rear portion is provided with a toothed rack segment 7 which is shaped for selective engagement with toothed rack or toothed belt 6. The two parts of the slide means are pivotably connected by the aid of a hinge 14, which is preferably provided at the upper portion of the slide means. At the lower portion of slide means a snap lock is provided comprising a pin portion 15' and a clamp portion 15''. To displace the back rest cushion it is pulled out of the back rest at its lower portion causing snap engagement 15 to be temporarily opened. The cushion is then moved to a desired position, and the lower portion, of the cushion is pushed towards the back rest, to cause a snap reengagement.

Figure 1:
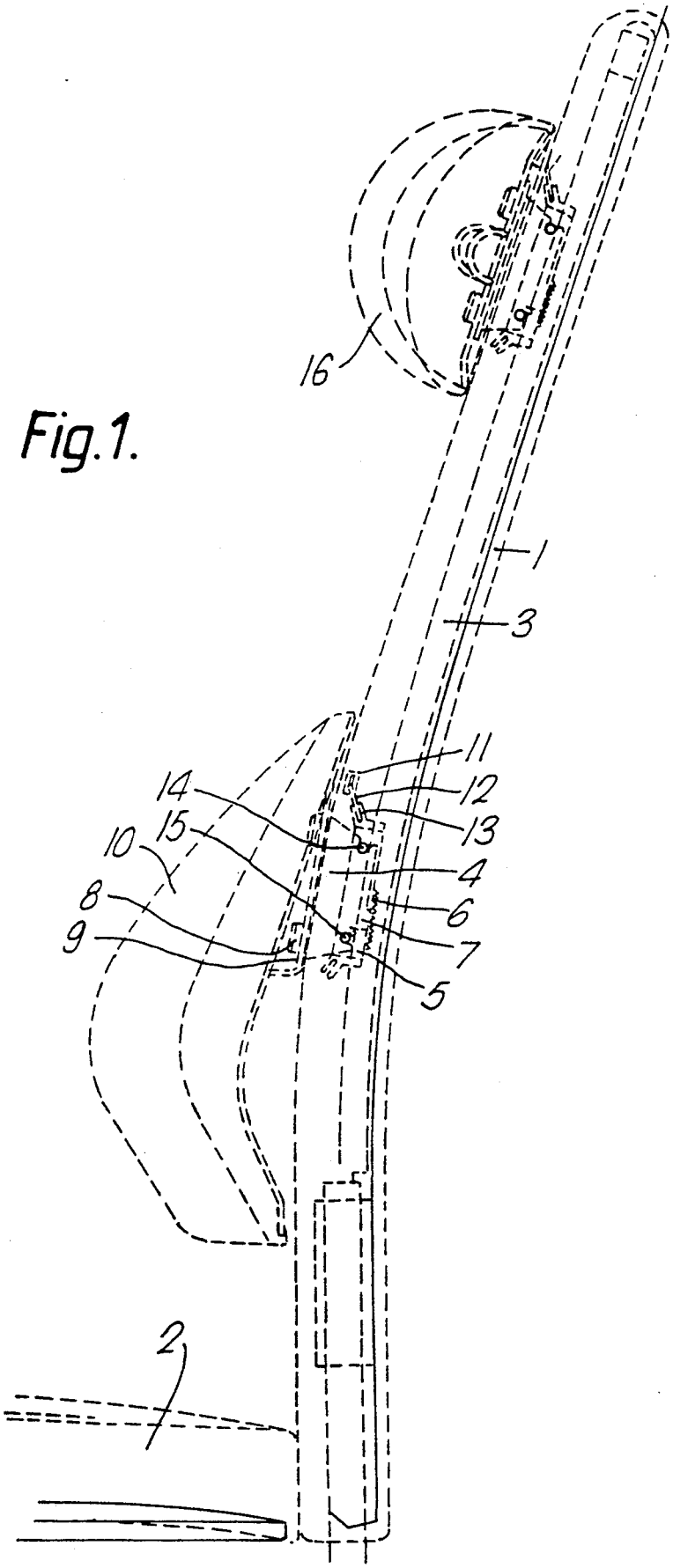
FIG. 1 shows a phantom view, as seen from one side, of a first embodiment of the arrangement according to the invention.

By ensuring that the slide means is only in contact with a groove in rail 3 at the end portions of the slide member, whereas there is a certain clearance between slide member and rail between said end portions, slide member 5 can also move across curved portions of back rest 1, as will appear from FIG. 1.

Figure 2:
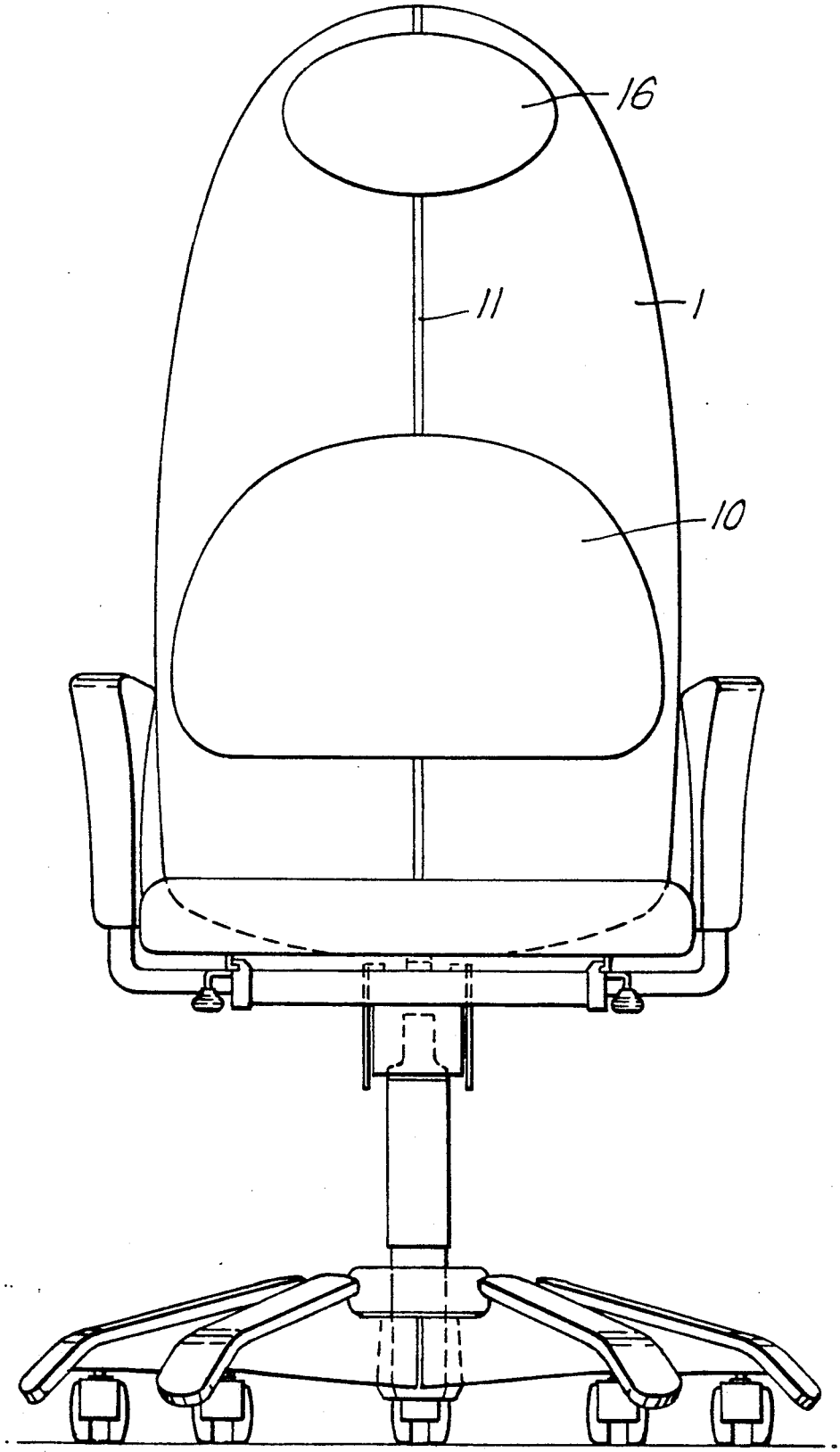
FIG. 2 illustrates a chair having a back rest and back rest cushions provided and supported according to the present invention.

In order to prevent any opening in the back rest above and below back rest cushion 10, a zipper 11 may be provided along the length of the back rest, as shown in FIG. 2. Gripping member 12 of the zipper is adapted to be inserted into and firmly held in an inclined position by a holder member 13 which is provided at the respective ends of slide member 5. Such an inclined position of zipper member 12 results in very simple operation of the zipper. This arrangement of the zipper and its actuating members provides the advantage that the front face of the back rest appears as an integrate surface, and that fingers or extraneous matter are prevented from entering into the slot along which slide means 4,5 is to move along the height of the back rest.

In FIG. 1 two back rest cushions are shown, viz. a cushion 10 for loin, and a cushion 16 for the back of the head 16. The principles for locking and displacement, however, are as disclosed above in connection with cushion 10.

Figure 3:
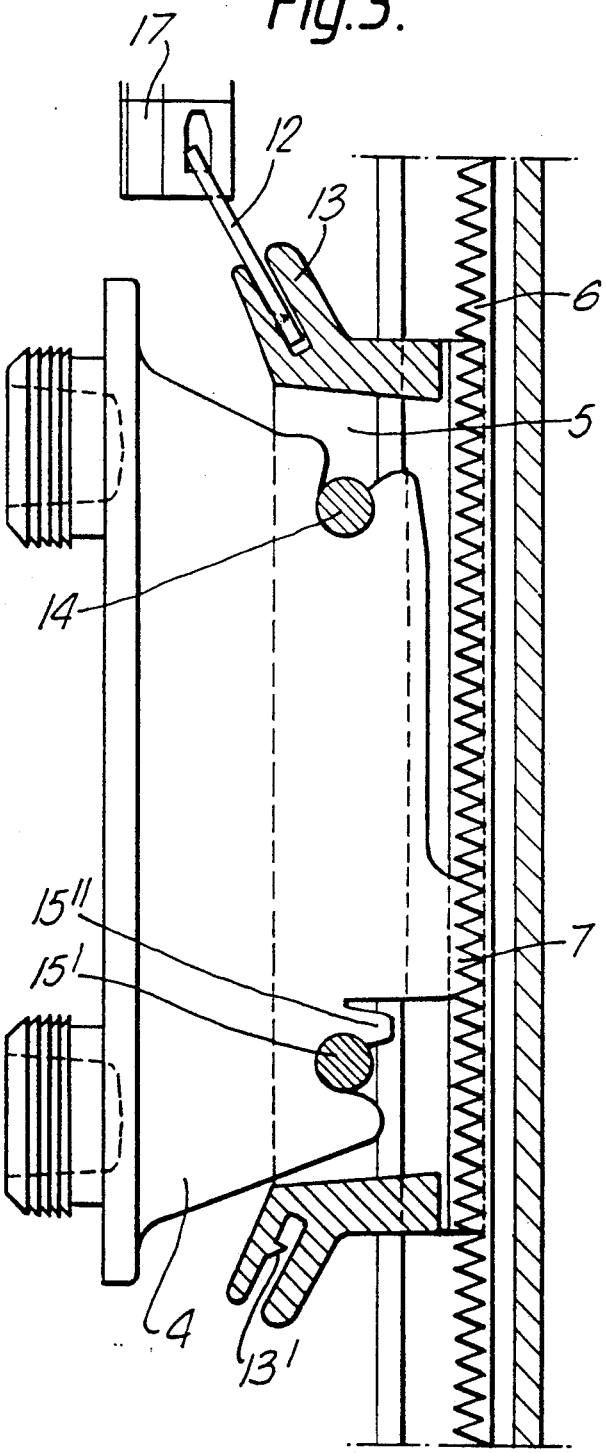
FIG. 3 is an enlarged section of the arrangement according to the invention as shown in FIG. 1.
Figure 4:
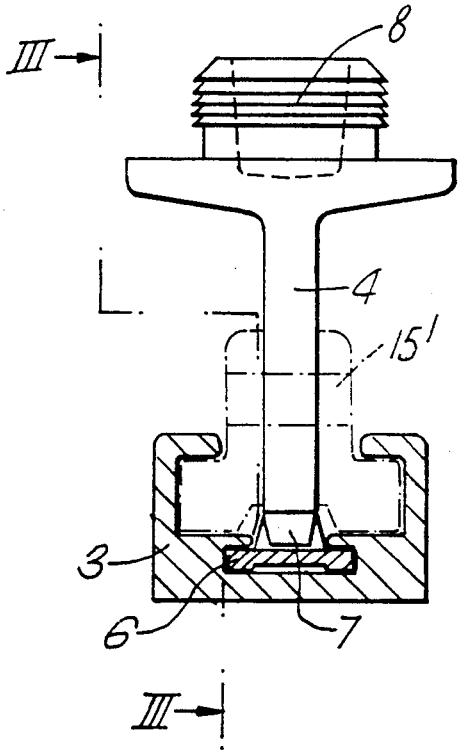
FIG. 4 is a cross section of the arrangement of FIG. 1.

As will appear in more detail from FIG. 3, zipper member 12 is firmly held in holder member 13 by the aid of a snap lock 13' engaging the opening of member 12. The locking portion 17 of the zipper is mounted on member 12 in a conventional manner. when the cushion is moved upwards, the uppermost zipper element 17 will, thus, cause opening of the zipper, whereas the lowermost element (not shown) will cause the zipper to be locked as the cushion is moved upwards. The back rest face will, thus, all the time appear as an integrate closed surface, independently of any upward or downward movement of the cushion.

It will appear from FIG. 5 that the cushion is to be moved by hand upwards or downwards along toothed belt 6 or toothed rack, as mentioned in connection with FIG. 1.

In FIG. 6, however, it is intended that it should not be necessary to disengage the lower portion of holder member and slide member to move the cushion. To this end engageing element 6 should be a toothed belt engaging toothed rack segment 7. Toothed belt 6 may be arranged to be an endless belt or a belt which is spring influenced to ensure that the belt is tensioned all the time. A toothed wheel 18 is driven by a motor 19 to displace belt 6 upwards or downwards, and cushion 10 and/or cushion 16 correspondingly. If desired, individual displacement of cushions 10 and 16 may be provided, and this should be achieved by respective driving means, as shown in FIG. 6.

The embodiment shown in FIG. 7 will be described inasmuch as it differs from the previously mentioned embodiments. Toothed belt 6 is here replaced by a screw which is actuated by a motor 21 (see FIG. 9), and slide member 5 is provided with a member 22 corresponding to a nut segment for engagement with screw 20. When screw 20 is rotated in its guide, as shown in FIG. 8, slide member 5 will, due to member 22, move upwards or downwards along the screw, as determined by the sense of rotation.

FIG. 10 shows a simplified embodiment where no members are provided in the rail to displace the cushion in the manner of the previous embodiments. On the other hand, a friction block 23 is provided on slide member 5. In case of a snap engagement between members 15' and 15" on holder member 4 friction block 23 will be urged with a certain force towards the bottom of rail 3. The concept of FIGS. 10, 11, and 12, thus, represents solely manual displacement of the cushion.

We claim:

1. An arrangement in connection with a height adjustable back rest cushion for use with a chair having a back rest and a seat, comprising a contoured rail disposed in said back rest at a position rearward from a front side of said back rest, said rail having a groove formed therein along a longitudinal direction of said rail, and a slide means including a slide member having a rear portion that is moveable along said groove and a cushion holder member having means on a front part for engagement with a rear portion of said back rest cushion so that said back rest cushion is moveable as an integrated part of said cushion holder member and with no relative movement to said slide member along said longitudinal direction, said cushion holder member having a rear part that is pivotally connected to one end of a front portion of said slide member and is snap lock engageable with an other end of said front portion of said slide member by a snap lock means when said cushion holder member is pivoted about said one end of said slide member front portion in a direction towards said rail.

2. An arrangement as claimed in claim 1, wherein the slide means is slidable in a longitudinal aperture in the front side of the back rest and engageable with a zipper means that covers said aperture so that said aperture remains closed above and below said slide means as the slide means is moved along said aperture.

3. An arrangement as claimed in claim 2, wherein at upper and lower end portions of the slide member a holder member is provided which has an opening for receiving a zipper gripping member of said zipper means, said opening facing obliquely outwards towards the front side of the back rest.

4. An arrangement as claimed in claim 1, wherein a first engagement member is provided in said groove of said rail, and that a second engagement member is provided in the rear part of the cushion holder member, said engagment members engaging upon operation of said snap lock means to interlock said slide means with said rail.

5. An arrangement as claimed in claim 4, wherein the first engagement member has a toothed surface, and that the second engagement member is a toothed rack segment that is complementary with with said toothed surface.

6. An arrangement as claimed in claim 5, wherein said first engagement member is firmly provided in said groove.

7. An arrangement as claimed in claim 4, wherein said first engagement member is a toothed belt which is movable along said groove in the rail by the aid of a toothed wheel which is driven by a selectively controllable motor.

8. An arrangement as claimed in claim 4, wherein said first engagement member is a rotatable screw extending along a substantial portion of the back rest and is rotated by a selectively controllable motor, said second engagement member consisting of a nut segment.

9. An arrangement as claimed in claim 1, wherein on the rear part of said cushion holder member a friction member is provided which in case of said snap locking penetrates into said groove and forms a frictional contact with the groove in rail.

* * * * *